US007574749B2

(12) United States Patent
Kogawa et al.

(10) Patent No.: US 7,574,749 B2
(45) Date of Patent: Aug. 18, 2009

(54) CATCHING TOOL AND METHOD OF DESIGNING CATCHING TOOL

(75) Inventors: Daisuke Kogawa, Osaka (JP); Masaki Terashita, Osaka (JP); Norifumi Ito, Osaka (JP); Kazunori Ayama, Osaka (JP)

(73) Assignee: Mizuno Corporation, Osaka (JP)

( * ) Notice: Subject to any disclaimer, the term of this patent is extended or adjusted under 35 U.S.C. 154(b) by 454 days.

(21) Appl. No.: 10/953,903

(22) Filed: Sep. 29, 2004

(65) Prior Publication Data

US 2005/0268367 A1 Dec. 8, 2005

(30) Foreign Application Priority Data

May 20, 2004 (JP) ..... 2004-150619

(51) Int. Cl.
*A63B 71/14* (2006.01)

(52) U.S. Cl. ..... 2/19; 2/164; 2/161.1; 2/163; 2/20; 2/21

(58) Field of Classification Search ..... 2/19, 2/21, 161.1, 161.4, 163, 164, 20, 906
See application file for complete search history.

(56) References Cited

U.S. PATENT DOCUMENTS

| | | | | |
|---|---|---|---|---|
| 3,532,344 | A * | 10/1970 | Masstab | 473/205 |
| 3,606,614 | A * | 9/1971 | Dimitroff | 2/159 |
| 3,890,648 | A * | 6/1975 | Beal | 2/20 |
| D243,132 | S * | 1/1977 | Lowrey | D29/122 |
| 4,748,690 | A * | 6/1988 | Webster | 2/161.1 |
| 5,285,529 | A * | 2/1994 | Arena | 2/20 |
| 6,292,946 | B1 * | 9/2001 | Angione | 2/20 |
| 6,430,745 | B2 * | 8/2002 | Murai | 2/19 |
| 6,732,377 | B1 * | 5/2004 | Wilkinson | 2/161.4 |
| 2006/0195967 | A1 * | 9/2006 | Kohler | 2/161.1 |

FOREIGN PATENT DOCUMENTS

| | | |
|---|---|---|
| JP | 63-38563 | 3/1988 |
| JP | 64-42079 | 3/1989 |
| JP | 04-053576 | 2/1992 |
| JP | 08-229181 | 9/1996 |
| JP | 09-225083 | 9/1997 |
| JP | 10-127852 | 5/1998 |
| JP | 2001-170241 | 6/2001 |
| JP | 2002-126153 | 5/2002 |

OTHER PUBLICATIONS

"A Study of Finger Pressure Distribution at Catching a Ball in the Baseball Glove," Norikazu Ninomiya, et al., *The Japan Society of Mechanical Engineers*, No. 00-38 Symposium Lecture Collection, pp. 17-20, Nov. 2000.

* cited by examiner

*Primary Examiner*—Gary L Welch
*Assistant Examiner*—Alissa J Tompkins
(74) *Attorney, Agent, or Firm*—Troutman Sanders; James E. Schutz; Filip A. Kowalewski

(57) ABSTRACT

A glove comprises an outer leather member including an outer leather pocket portion and an outer leather back face portion, an inner leather member, inserted in the outer leather member, having a palm member provided along the outer leather pocket portion and a back member provided along the outer leather back face portion, finger portions formed between the palm member and the back member for receiving the fingers of a wearer of the catching tool and a reinforcing portion selectively provided on a specific position of the palm member.

18 Claims, 19 Drawing Sheets

CATCHING TOOL AND METHOD OF DESIGNING CATCHING TOOL

This nonprovisional application is based on Japanese Patent Application No. 2004-150619 filed with the Japan Patent Office on May 20, 2004, the entire contents of which are hereby incorporated by reference.

BACKGROUND OF THE INVENTION

1. Field of the Invention

The present invention relates to a catching tool and a method of designing a catching tool, and more particularly, it relates to a catching tool such as a baseball or softball glove and a method of designing this catching tool.

2. Description of the Background Art

For example, Japanese Patent Laying-Open No. 2002-126153 (Conventional Example 1) describes a conventional catching tool.

Conventional Example 1 discloses a catching tool comprising a front leather member formed by sewing a leather pocket portion and a leather back face portion, a back leather member, inserted in the front leather member, formed by sewing a leather palm portion and a leather back portion and a core member, stored in the front leather member, having reinforcing side portions.

"A study of finger pressure distribution at catching a ball in the baseball glove" by Norikazu NINOMIYA et al. (the Japan Society of Mechanical Engineers "No. 00-38" Symposium Lecture Collection, the Japan Society of Mechanical Engineers, Corporation Aggregate, November 2000, p. 17-20) (Conventional Example 2) discloses a method of measuring finger pressure distribution in a baseball glove at the time of catching a ball with a thin grip distribution measuring system.

However, the aforementioned catching tool has the following problem:

At the time of catching a ball, movements of the fingers of a wearer of the catching tool vary with the wearer having characteristics specific to his/her position, for example. Therefore, it is desirable to provide a catching tool enabling the wearer to readily catch a ball in response to his/her manner of application of finger power.

However, neither Conventional Example 1 nor Conventional Example 2 discloses the idea of designing a catching tool responsive to the characteristics of finger movements of the wearer.

From a viewpoint different from the above, neither Conventional Example 1 nor Conventional Example 2 discloses an idea of providing a reinforcer on an inner leather palm (palm portion).

SUMMARY OF THE INVENTION

An object of the present invention is to provide a catching tool enabling the wearer to readily catch a ball and a method of designing this catching tool.

According to an aspect, the inventive catching tool comprises an outer leather member including a pocket portion and a back face portion, an inner leather member, inserted in the outer leather member, having a palm portion provided along the pocket portion and a back portion provided along the back face portion and a reinforcing portion selectively provided on a part of the palm portion corresponding to the vicinity of the tips of four fingers, i.e., the index finger, the middle finger, the ring finger and the little finger of a wearer of the catching tool received in finger portions formed between the back portion and the palm portion.

Thus, power applied from the fingertips of the wearer to the catching tool is so readily transmitted to the periphery that the wearer can readily catch a ball as a result.

As an example, the aforementioned reinforcing portion is formed to extend from the part corresponding to the vicinity of the tips of the four fingers toward the bases of the four fingers.

Thus, power applied from the bases of the fingers to the catching tool is readily transmitted to the periphery along with the power applied from the fingertips.

According to another aspect, the inventive catching tool comprises an outer leather member including a pocket portion and a back face portion, an inner leather member, inserted in the outer leather member, having a palm portion provided along the pocket portion and a back portion provided along the back face portion and a reinforcing portion selectively provided on a part of the palm portion in the vicinity of portions corresponding to only two fingers, i.e., the ring finger and the little finger of a wearer of the catching tool received in finger portions formed between the back portion and the palm portion.

Thus, power applied from the ring and little fingers of the wearer to the catching tool is so readily transmitted to the periphery that the wearer can readily catch a ball as a result.

As an example, the aforementioned reinforcing portion is formed to extend from the part corresponding to the vicinity of the tips of the aforementioned two fingers toward the bases of the two fingers.

Thus, power applied from the entire ring and little fingers of the wearer to the catching tool is readily transmitted to the periphery.

As another example, the aforementioned reinforcing portion is formed to extend from the p art corresponding to the vicinity of the tips of the aforementioned two fingers toward the forward ends of the finger portions receiving the two fingers.

Thus, power applied from the ring and little fingers to the catching tool is readily transmitted to the forward ends of the finger portions of the catching tool.

According to still another aspect, the inventive catching tool comprises an outer leather member including a pocket portion and a back face portion, an inner leather member, inserted in the outer leather member, having a palm portion provided along the pocket portion and a back portion provided along the back face portion and a reinforcing portion selectively provided on a part of the palm portion in the vicinity of portions corresponding to only three fingers, i.e., the middle finger, the ring finger and the little finger of a wearer of the catching tool received in finger portions formed between the back portion and the palm portion.

Thus, power applied from the middle, ring and little fingers of the wearer to the catching tool is so readily transmitted to the periphery that the wearer can readily catch a ball as a result.

As an example, the aforementioned reinforcing portion is formed to extend from the part corresponding to the vicinity of the tips of the aforementioned three fingers toward the bases of the three fingers.

Thus, power applied from the entire middle, ring and little fingers to the catching tool is readily transmitted to the periphery.

As another example, the aforementioned reinforcing portion is formed to extend from the part corresponding to the vicinity of the tips of the aforementioned three fingers toward the forward ends of the finger portions receiving the three fingers.

Thus, power applied from the middle, ring and little fingers to the catching tool is readily transmitted to the forward ends of the finger portions of the catching tool.

According to a further aspect, the inventive catching tool comprises an outer leather member including a pocket portion and a back face portion, an inner leather member, inserted in the outer leather member, having a palm portion provided along the pocket portion, a back portion provided along the back face portion as well as an index finger portion, a middle finger portion, a ring finger portion and a little finger portion receiving the index finger, the middle finger, the ring finger and the little finger of a wearer of the catching tool respectively and a reinforcing portion selectively provided on a part of the palm portion forming the bases of the index finger portion, the middle finger portion, the ring finger portion and the little finger portion.

According to a further aspect, the inventive catching tool comprises an outer leather member including a pocket portion and a back face portion, an inner leather member, inserted in the outer leather member, having a palm portion provided along the pocket portion, a back portion provided along the back face portion as well as a ring finger portion and a little finger portion receiving the ring finger and the little finger of a wearer of the catching tool respectively and a reinforcing portion selectively provided on a part of the palm portion forming the bases of the ring finger portion and the little finger portion.

According to a further aspect, the inventive catching tool comprises an outer leather member including a pocket portion and a back face portion, an inner leather member, inserted in the outer leather member, having a palm portion provided along the pocket portion, a back portion provided along the back face portion as well as a middle finger portion, a ring finger portion and a little finger portion receiving the middle finger, the ring finger and the little finger of a wearer of the catching tool respectively and a reinforcing portion selectively provided on a part of the palm portion forming the bases of the middle finger portion, the ring finger portion and the little finger portion.

According to a further aspect, the inventive catching tool, comprising a pocket portion and a back face portion, is selectively provided with a reinforcing portion only in the vicinity of a part, inside the pocket portion, for locating the tip of any finger of a wearer of the catching tool.

According to a further aspect, the inventive catching tool, comprising a pocket portion and a back face portion, is selectively provided with a reinforcing portion only on parts, inside the pocket portion, corresponding to the ring finger and the little finger of a wearer of the catching tool.

According to a further aspect, the inventive catching tool, comprising a pocket portion and a back face portion, is selectively provided with a reinforcing portion only on parts, inside the pocket portion, corresponding to the middle finger, the ring finger and the little finger of a wearer of the catching tool.

Also according to any of the aforementioned structures, power applied from any fingertip or the entire one of a specific finger of the wearer to the catching too is so readily transmitted to the periphery that the wearer can readily catch a ball as a result.

The aforementioned "parts corresponding to the middle finger, the ring finger and the little finger" indicate part or all of regions between portions of the catching tool where the middle, ring and little fingers of the wearer are located and the forward ends of a middle fingerstall, a ring fingerstall and a little fingerstall respectively.

A method of designing a catching tool according to the present invention comprises the steps of measuring distribution of pressure applied by the fingers of a wearer of the catching tool to the catching tool when catching a ball with a pressure sensor and providing a reinforcing portion on a portion receiving relatively large pressure inside a pocket portion in the catching tool on the basis of a result of measurement in the measuring step Thus, it is possible to improve the rigidity of portions to which the wearer applies relatively large pressure when catching a ball, for transmitting power applied from the fingers of the wear to a relatively wide range. Consequently, it is possible to provide a catching tool enabling the wearer to readily catch a ball.

According to the present invention, as hereinabove described, it is possible to enable the wearer to readily catch a ball with the catching tool by arranging the reinforcing portion in response to the characteristics of the manner of the wearer applying his/her finger power when catching a ball.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
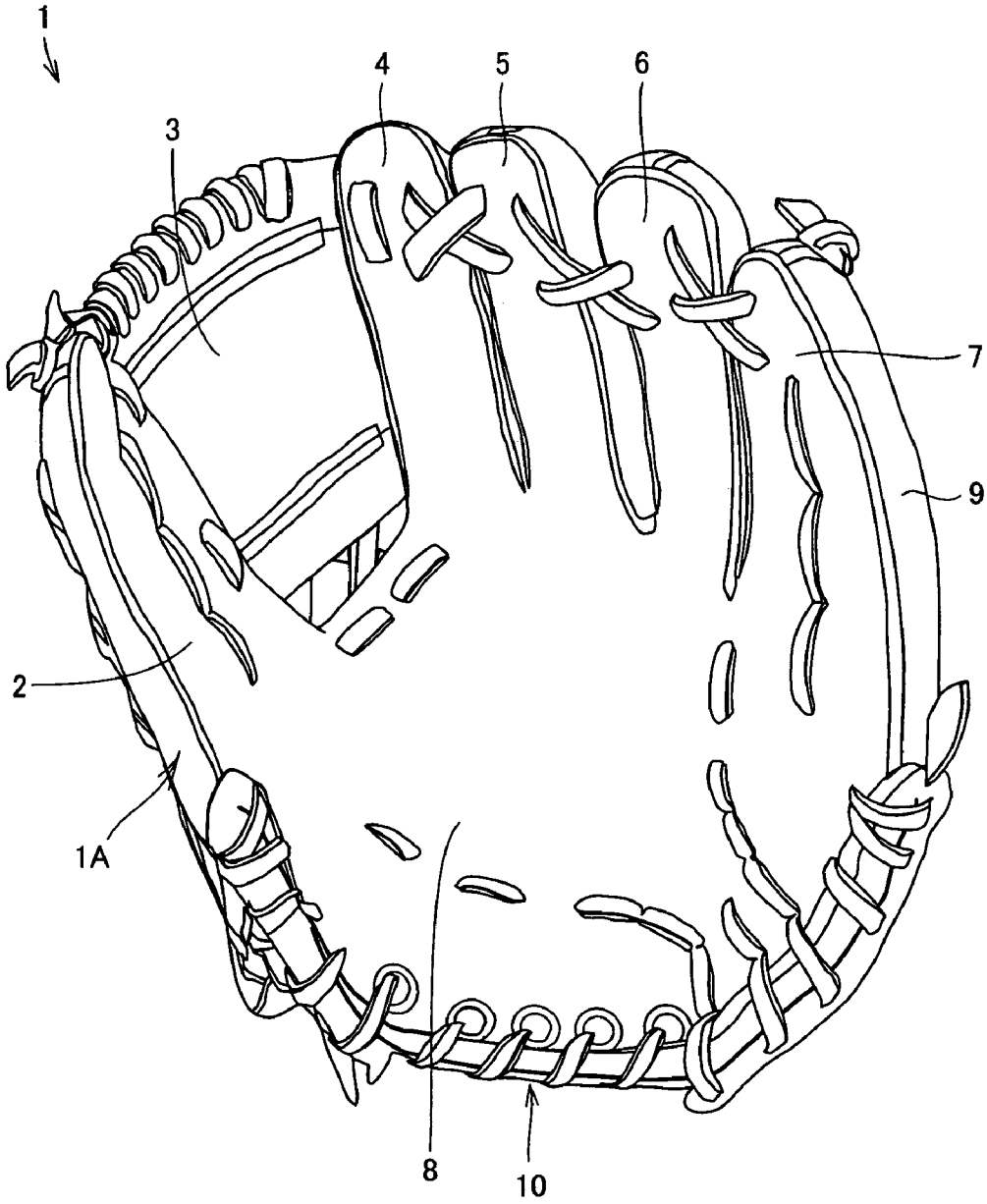
FIG. 1 is a front elevational view of a catching tool according to each of Examples 1 to 13 of the present invention.

Embodiments of a catching tool according to the present invention and a method of designing this catching tool are now described.

Throughout the specification, the term "catching tool" indicates a tool such as a baseball or softball glove or a mitt for catching a ball.

The catching tool according to this embodiment comprises an outer leather member including a pocket portion and a back face portion, an inner leather member, inserted in the outer leather member, having a palm portion provided along the pocket portion and a back portion provided along the back face portion, finger portions formed between the back portion and the palm portion for receiving the fingers of a wearer of the catching tool and a reinforcing portion selectively provided on a specific part of the palm portion.

The part of the palm portion provided with the reinforcing portion has relatively higher rigidity as compared with the peripheral portion thereof Therefore, power applied onto the reinforcing portion is readily transmitted to the periphery (more specifically, the forward ends of the respective fingerstalls, for example).

The reinforcing portion is typically formed by superpositively mounting (sewing or pasting) a reinforcing member on (to) the palm portion. The reinforcing member may be prepared from the same material as the palm portion or a material harder or softener than that for the palm portion.

The reinforcing portion may be provided on the inner side surface of the pocket portion of the outer leather member or on the surface of the palm portion of the inner leather member closer to the pocket portion or the hand of a wearer of the catching tool.

Alternatively, the reinforcing portion may be formed by partially cutting off the palm portion and providing a member harder than the palm portion or by partially soaking the palm portion with a hardener, for example.

The reinforcing portion is provided on a part corresponding to a portion to which the wearer applies relatively larger power when catching a ball. Thus, the power applied by the wearer can be transmitted to a wider range, so that the wearer can readily catch the ball as a result.

The portion to which the wearer applies relatively larger power when catching a ball, varying with each player, can conceivably be classified in a constant range. For example, a method of classifying the portion in response to the fielding position of the player is conceivable.

For example, a first baseman tends to concentrate power to the entire middle and ring fingers and a portion around the base of the little finger. A second baseman or a shortstop tends to concentrate power to the thumb and the forward ends of the middle to little fingers. When making a back-handed catch, however, the second baseman or the shortstop tends to concentrate power to the entire middle and ring fingers and a portion around the base of the little finger. A third baseman tends to concentrate power to the thumb and the entire middle to little fingers. Further, an outfielder tends to concentrate power to the thumb and the entire ring and little fingers.

Thus, the portion to which the player concentrates power when catching a ball can be classified in response to the position of the player, and hence it is effective set the position of the reinforcing member in response to the player's position.

The reinforcing member may be arranged on a portion corresponding to the vicinity of the tips of four fingers, i.e., the index, middle, ring and little fingers of the wearer, a portion corresponding to the vicinity of only three fingers, i.e., the middle, ring and little fingers, a portion corresponding to the vicinity of only two fingers, i.e., the ring and little fingers, for example.

A catching tool prepared by arranging a reinforcing member on the portion corresponding to the vicinity of the tips of the aforementioned four fingers (index to little fingers) is typically employed by a second baseman or a shortstop. The second baseman or the shortstop tends to concentrate power to the fingertips when catching a ball as hereinabove described, and hence the power applied by the wearer can be transmitted to a wider range by selectively arranging the reinforcing member on the portion corresponding to the vicinity of the fingertips. Consequently, the wearer can readily catch a ball with this catching tool.

In this case, the reinforcing member may be formed to extend from the portion corresponding to the vicinity of the tips of the four fingers toward the bases of the four fingers.

Thus, power applied from the bases of the fingers to the catching tool can be readily transmitted to the periphery along with power applied from the fingertips.

A catching tool prepared by arranging a reinforcing member on the portion corresponding to the vicinity of only the aforementioned three fingers (middle to little fingers) is typically employed by a third baseman. The third baseman tends to concentrate power to the middle, ring and little fingers when catching a ball as described above, and hence power applied by the wearer can be transmitted to a wider range by selectively arranging the reinforcing portion on the portion corresponding to the vicinity of the aforementioned three fingers.

In this case, the reinforcing member may be formed to extend from the portion corresponding to the vicinity of the tips of the three fingers toward the bases of the three fingers, or to extend from the portion corresponding to the vicinity of the tips of the three fingers toward the forward ends of the finger portions receiving the three fingers.

Thus, power applied from the middle, ring and little fingers to the catching tool is readily transmitted to the periphery. Alternatively, power applied from the middle, ring and little fingers to the catching tool is readily transmitted to the forward ends of the fingerstalls of the catching tool.

A catching tool prepared by arranging a reinforcing member on the portion corresponding to the vicinity of only the aforementioned two fingers (ring and little fingers) is typically employed by an outfielder. The outfielder tends to concentrate power to the ring and little fingers when catching a ball as described above, and hence power applied by the wearer can be transmitted to a wider range by selectively arranging the reinforcing member on the portion corresponding to the vicinity of the aforementioned two fingers. Consequently, the wearer can readily catch a ball with this catching tool.

In this case, the reinforcing member may be formed to extend from the portion corresponding to the vicinity of the tips of the two fingers, or to extend from the portion corresponding to the vicinity of the tips of the two fingers toward the forward ends of the finger portions receiving the two fingers.

Thus, power applied from the entire ring and little fingers to the catching tool is readily transmitted to the periphery. Alternatively, power applied from the ring and little fingers to the catching tool is readily transmitted to the forward ends of the fingerstalls of the catching tool.

A part of the palm portion coming into contact with the index to little fingers of the wearer corresponds to a portion in the vicinity of the bases of the index, middle, ring and little finger portions of the catching tool receiving the index, middle, ring and little fingers of the wearer respectively.

In other words, therefore, the catching tool according to this embodiment comprises an outer leather member including a pocket portion and a back face portion, an inner leather member having a palm portion, inserted in the outer leather member, provided along the pocket portion, a back portion provided along the back face portion as well as index, middle, ring and little finger portions receiving the index, middle, ring and little fingers of a wearer of the catching tool respectively and a reinforcing portion selectively provided on a part of the palm portion forming the bases of specific finger portions.

The finger portions provided with the reinforcing portion on the bases thereof are the index, middle, ring and little finger portions according to an aspect (for a second baseman or a shortstop), the middle, ring and little finger portions according to another aspect (for a third baseman), and the ring and little finger portions according to still another aspect (for an outfielder).

While the aforementioned catching tool comprises the outer leather member and the inner leather member, the present invention is not restricted to such a catching tool but any catching tool is included in the present invention so far as a reinforcing portion is provided on a prescribed position inside a pocket portion.

From this point of view, the aforementioned catching tool is summarized as follows: The catching tool according to this embodiment comprises a pocket portion and a back face portion, and is selectively provided with a reinforcing portion only on a prescribed part inside the pocket portion.

The reinforcing portion may conceivably be provided in the vicinity of portions for locating the fingertips of the wearer, portions corresponding to the ring and little fingers of the wearer (part or all of regions between the portions for locating the ring and little fingers of the wearer and the forward ends of the ring and little finger portions, portions corresponding to the middle, ring and little fingers of the wearer (part or all of regions between the portions for locating the middle, ring and little fingers of the wearer and the forward ends of the middle, ring and little finger portions) or the like.

This embodiment provides a catching tool with which the wearer can readily catch a ball in response to the manner of applying finger power when catching the ball.

A method of designing the aforementioned catching tool is now described.

Figure 25:
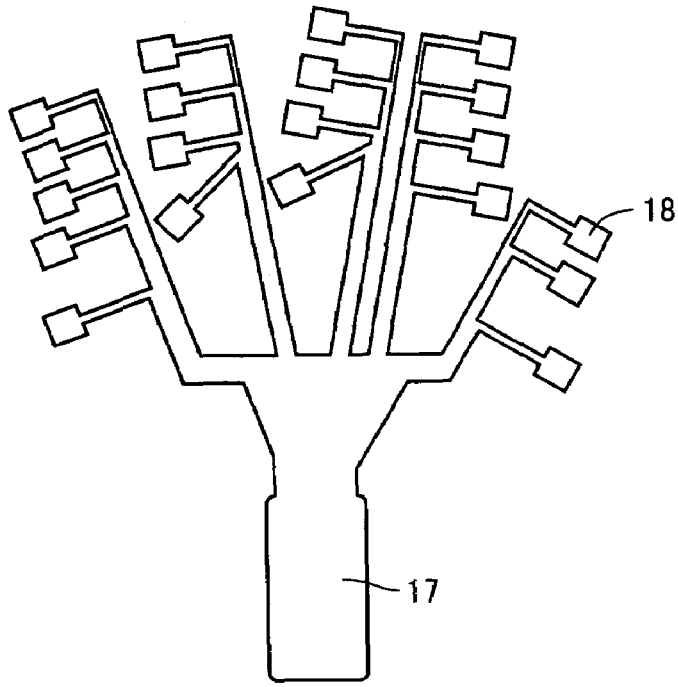
FIG. 25 illustrates a sensor for measuring the power applied by a wearer of a catching tool to the catching tool.
Figure 26:
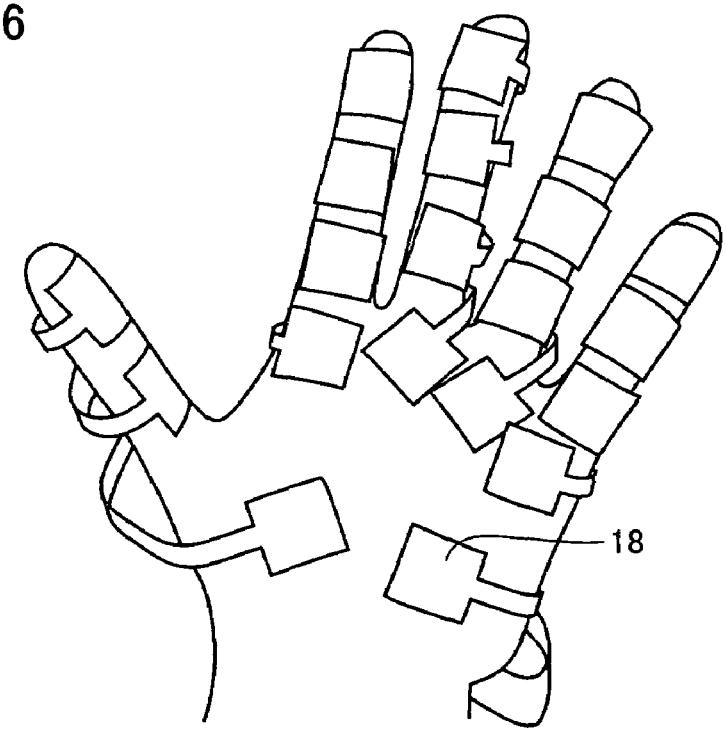
FIG. 26 illustrates the sensor shown in FIG. 25 attached to the hand of the wearer.

As shown in FIG. 25, a sensor unit 17 is branched into five portions each having a plurality of sensor parts 18. The sensor unit 17 is readily deformable to be wound on the hand of a wearer so that the sensor parts 18 are arranged on prescribed positions of the palm/fingers of the wearer, as-shown in FIG. 26. The sensor unit 17 is provided with 20 sensor parts 18 in total.

Figure 27:
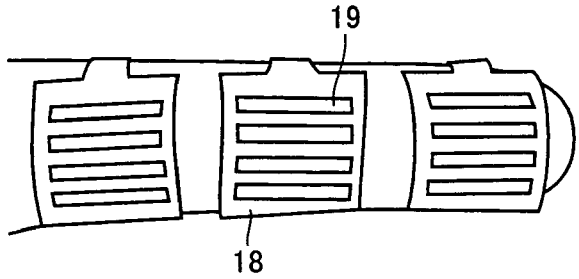
FIG. 27 illustrates finger portions appearing in FIG. 26 in an enlarged manner.

Referring to FIG. 27, each sensor part 18 comprises sensors 19 arranged in four lines. Four measuring points are arranged on each sensor 19 along the extensional direction of the sensor 19. In other words, each sensor part 18 is formed with 16 (4 by 4) measuring points.

For example, Glove Scan by Nitta Corporation is employed as the sensor unit 17. The thickness of the sensor unit 17 is about 0.15 mm, and the size of the overall sensor unit 17 is about 200 by 400 mm. The size of each sensor part 18 is about 16 by 16 mm. The sensor unit 17 has 320 (20 by 4 by 4) measuring points, for measuring pressure applied to each measuring point every 0.01 seconds in the range of about 2 to 200 kPa.

Exemplary relation between lapses of time in a ball catching operation and results of measurement through the sensor unit 17 (the magnitude of power applied by the wearer of a catching tool to the catching tool) is described with reference to FIG. 28.

Figure 28:
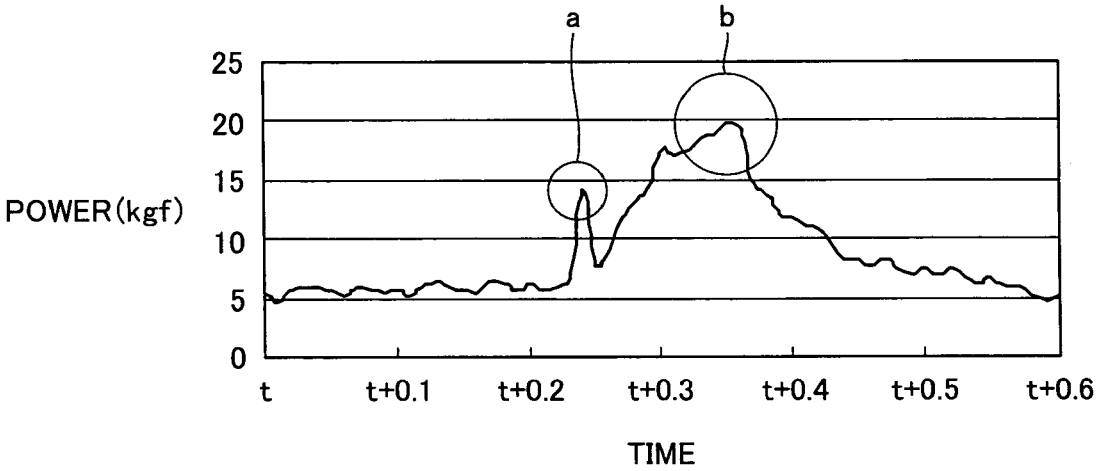
FIG. 28 illustrates the relation between lapses of time in a ball catching operation and the magnitude of power applied by the wearer of the catching tool to the catching tool.

Referring to FIG. 28, the power (kgf) shown on the axis of ordinates is obtained by multiplying the average value of pressure (kgf/mm$^2$) measured on each measuring point by the total (16×16×20=5120 mm$^2$) of the areas of the sensor parts 18.

Referring to FIG. 28, a point-a shows the peak of power at the instant when a ball jumps into (hits) the catching tool. A point-b shows the peak of the grip of the wearer. Thus, the peak of the grip appears after the ball hits the catching tool. According to this embodiment, the value of the power at the point-b is measured.

Figure 29:
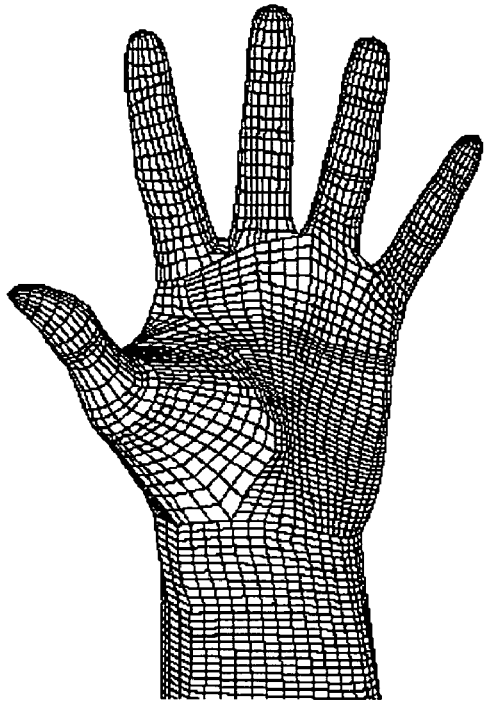
FIG. 29 polygonally illustrates a hand model.

The results of measurement through the sensor unit 17 are displayed on a hand model shown in FIG. 29.

Figure 30:
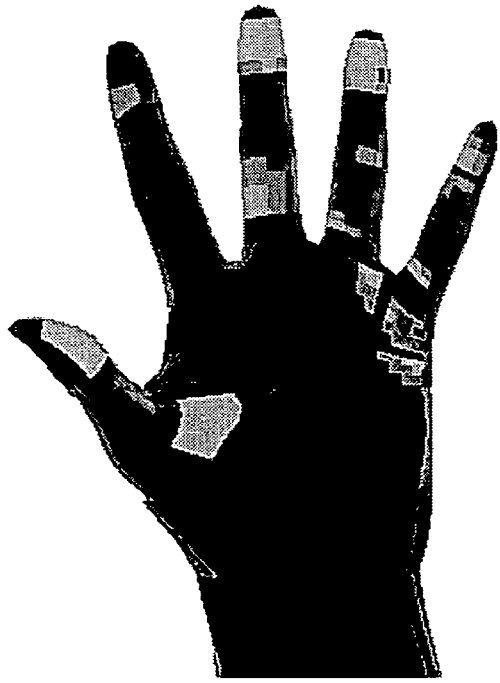
FIG. 30 illustrates results of measurement obtained by the sensor shown in FIGS. 25 to 27 on the hand model shown in FIG. 29.

FIG. 30 shows results of measurement of a second baseman or a shortstop catching a ball. Referring to FIG. 30, relatively larger power is applied to white portions as compared with black portions. In other words, the relatively large power is applied to the thumb and the forward ends of the middle to little fingers.

From the results shown in FIG. 30, it is conceivable as possible to transmit relatively large power applied at the time of catching a ball to a wider range by selectively providing a reinforcing portion on a part of a palm portion in the vicinity of the index to little fingers of a wearer in a glove for a second baseman or a short stop, for example. The maximum power acts in the vicinity of the tips of the middle to little fingers, and hence the reinforcing portion may be provided in the vicinity of the tips of only the middle to little fingers.

As to the aforementioned contents, the method of designing a catching tool is summarized as follows: The method of designing a catching tool according to this embodiment comprises the steps of measuring distribution of pressure applied by the fingers of a wearer of the catching tool to the catching tool when catching a ball with a sensor unit 17 (pressure sensor) and providing a reinforcing portion on a part receiving relatively large pressure inside a pocket portion of the catching tool on the basis of a result of measurement in the measuring step.

EXAMPLE 1

A glove 1 according to Example 1 of the present invention comprises an outer leather member 1A formed by binding an outer leather pocket portion (pocket portion) 8 including a pocket portion and an outer leather back face portion (back face portion) 9 with each other with leather strings or the like. This outer leather member 1A is constituted of a material mainly composed of a material such as natural leather or synthetic leather, for example.

As shown in FIG. 1, the outer leather member 1A comprises a thumb stall 2, an index finger stall (first fingerstall) 4, a middle finger stall (second fingerstall) 5, a ring finger stall (third fingerstall) 6 and a little finger stall (fourth fingerstall) 7 receiving the thumb, the index finger, the middle finger, the ring finger and the little finger of a wearer of the glove 1 respectively, a web portion 3 provided between the thumb stall 2 and the index finger stall 4 and a hand receiving portion 10 for receiving the wearer's hand in the glove 1.

Figure 2:
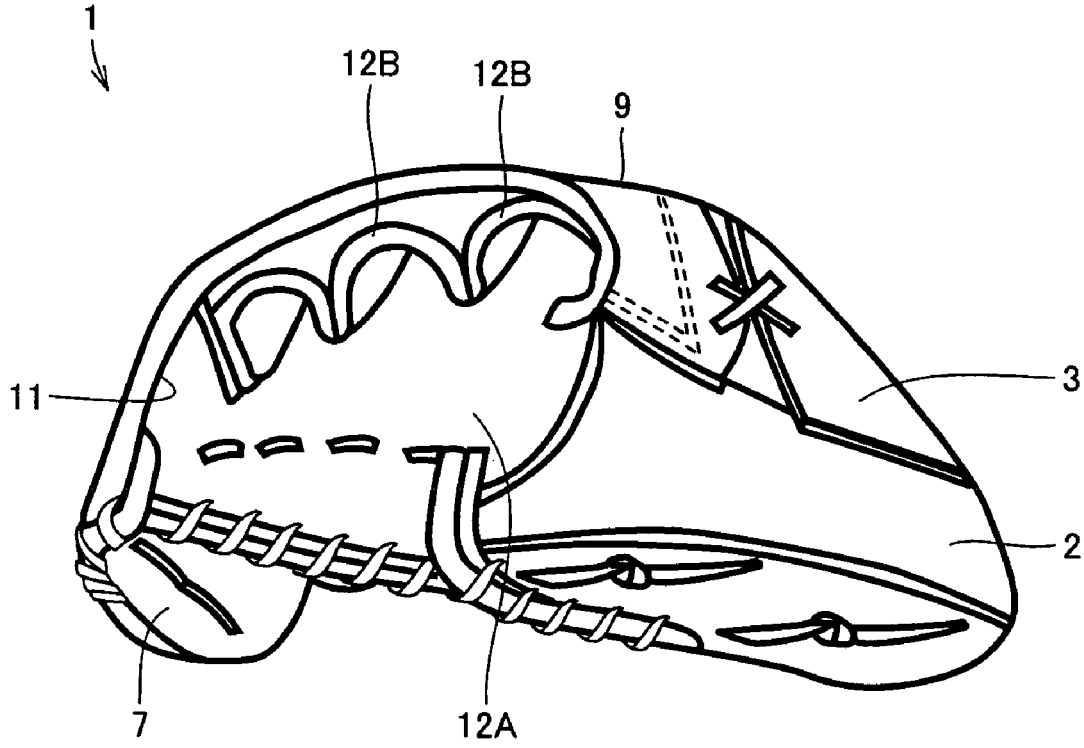
FIG. 2 illustrates the internal structure of the catching tool according to each of Examples 1 to 13 of the present invention.

As shown in FIG. 2, the glove 1 is provided on the outer leather back face portion 9 with an opening 11 partially exposing the back of the wearer's hand, while this opening 11 is omissible. FIG. 2 omits illustration of portions closer to the wearer's wrist than the opening 11 for convenience of illustration.

The glove 1 is formed by inserting an inner leather member 12 comprising a palm member (palm portion or inner leather palm portion) 12A and a back member (back portion or inner leather back portion) 12B into the aforementioned outer leather member 1A and binding the inner leather member 12 and the outer leather member 1A with each other with leather strings or the like.

Figure 3:
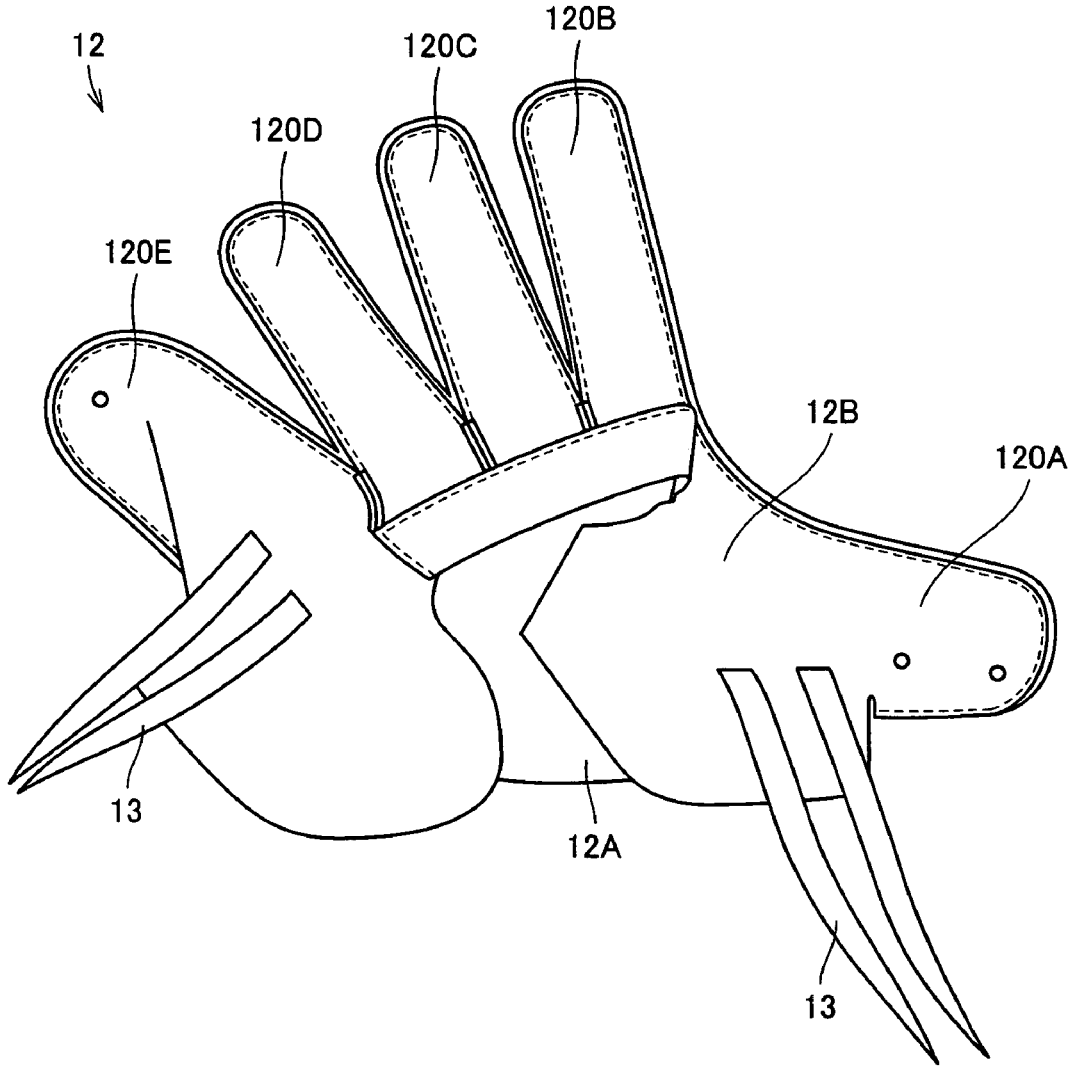
FIG. 3 is a top plan view of an inner leather member of the catching tool according to each of Examples 1 to 13 of the present invention.

As shown in FIG. 3, the inner leather member 12 is formed by sewing the palm member 12A arranged on the wearer's palm and the back member 12B arranged on the back of the wearer's hand with each other.

This inner leather member 12 has a thumb portion 120A, an index finger portion (first finger portion) 120B, a middle finger portion (second finger portion) 120C, a ring finger portion (third finger portion) 120D and a little finger portion (fourth finger portion) 120E receiving the thumb, the index finger, the middle finger, the ring finger and the little finger of the wearer respectively. The thumb portion 120A and the little finger portion 120E are provided with thumb/finger holders 13 for fixing the thumb and the little finger in the thumb portion 120A and the finger portion 120E respectively.

The palm member 12A and the back member 12B are made of softly tanned leather in consideration of touch of the wearer wearing the glove 1.

Figure 4:
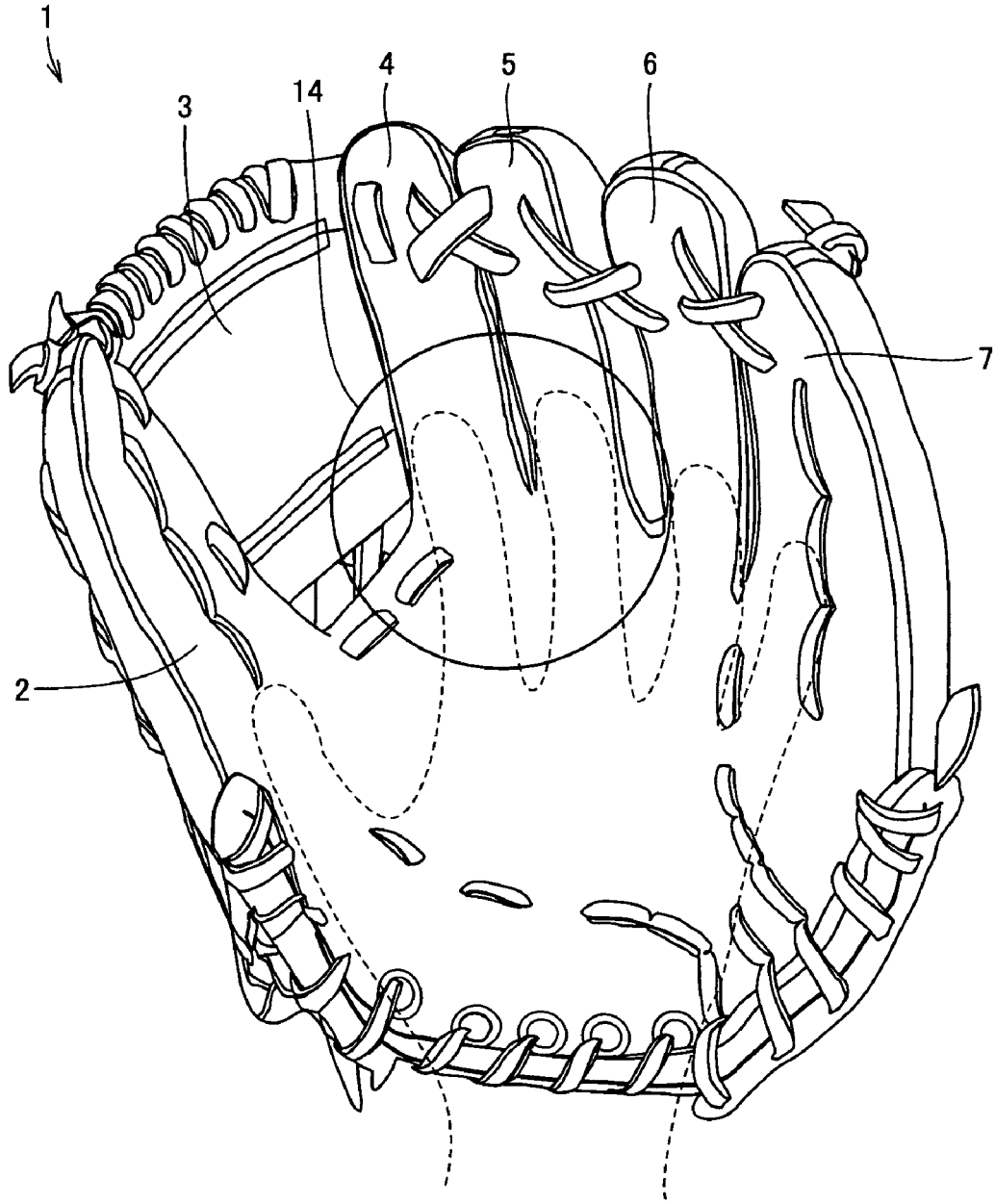
FIG. 4 illustrates exemplary positional relation between the catching tool according to each of Examples 1 to 13 of the present invention and the hand of a wearer of the catching tool catching a ball with this catching tool.

Referring to FIG. 4, the wearer's thumb and fingers (shown by a broken line) merely reach portions around the middles of the thumb and finger stalls 2 and 4 to 7 of the glove 1. Therefore, the wearer can readily grab and catch a ball with the glove 1 by rendering his/her finger power readily transmittable to the periphery. A reinforcer (reinforcing portion) 15 is provided as the means therefor.

Figure 5:
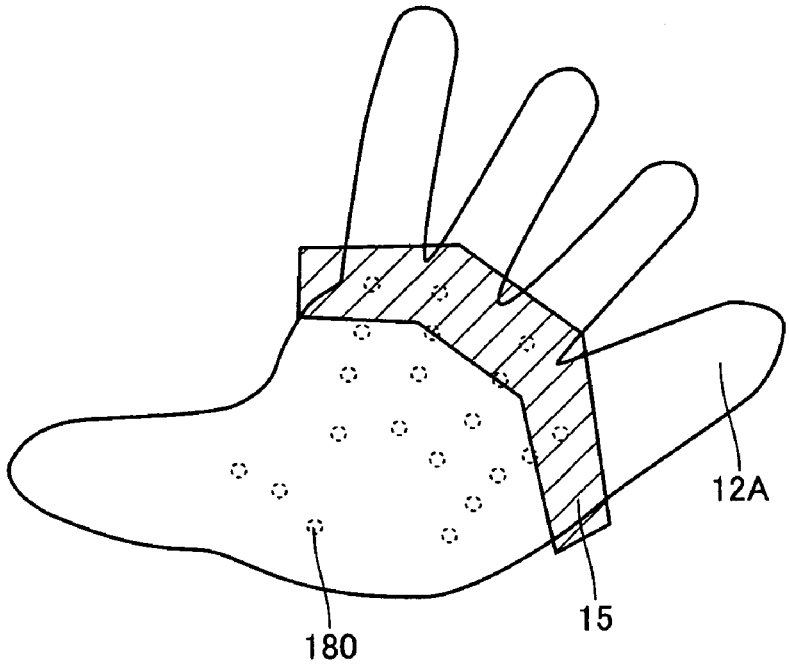
FIGS. 5 to 17 illustrate arrangements of reinforcing members on palm portions of inner leather members in the catching tools according to Examples 1 to 13 of the present invention respectively.

The arrangement of the reinforcer (reinforcing portion) 15 on the palm member (inner leather palm portion) 12A of the glove 1 is described with reference to FIG. 5. FIG. 5 illustrates the palm member 12A shown in FIG. 3 as viewed from the surface of the side coming into contact with the outer leather member 1A. Referring to FIG. 5, circles shown in broken lines denote the centers of the sensor parts 18 (measuring positions 180: see FIG. 26) mounted on the wearer's hand respectively.

Referring to FIG. 5, the reinforcer 15 is zonally provided on the surface, coming into contact with the wearer's palm, of the palm member 12A in the vicinity of the tips of the index to little fingers of the wearer. This reinforcer 15 is bonded to the palm member 12A.

Production efficiency can be improved by reinforcing the tips of the index to little fingers with the single reinforcer 15 as shown in FIG. 5. When the wearer applies power to the tip of a certain finger, this power readily reaches portions close to the tips of the remaining fingers. In other words, transmission of transverse power (from the index finger toward the little finger) can be ensured.

The glove 1 according to Example 1 is typically employed by a second baseman or a shortstop.

The reinforcer 15 is constituted of cowhide, ball leather or laminated fabric.

EXAMPLE 2

A glove 1 according to Example 2 of the present invention is a modification of the glove 1 according to the aforementioned Example 1, and basically has a structure similar to that of the glove 1 according to Example 1.

Figure 6:
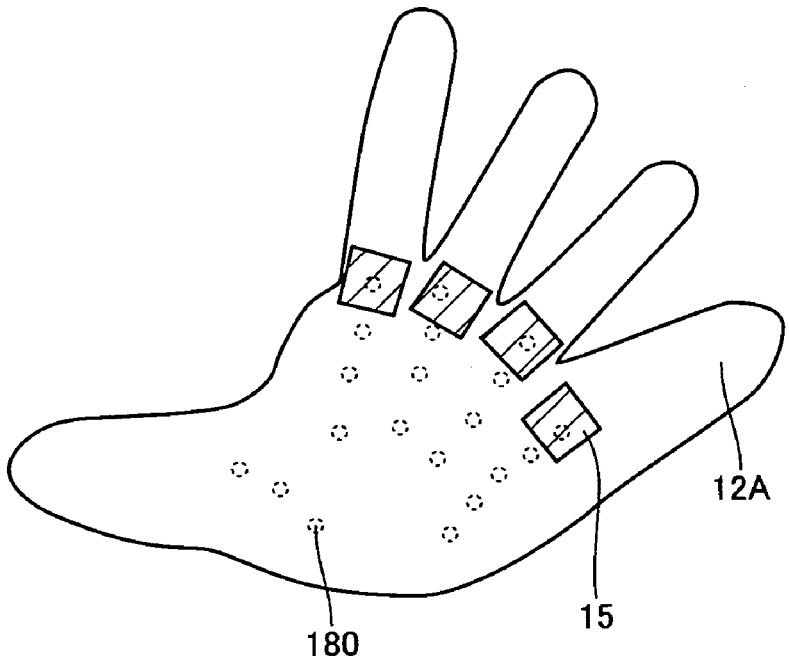

Referring to FIG. 6, a reinforcer 15 is divided into four portions having square shapes respectively on the surface, coming into contact with the palm of a wearer of the glove 1, of a palm member 12A in the vicinity of the tips of the index to little fingers of the wearer.

It is possible to ensure flexibility of the glove 1 by dividing the reinforcer 15 into four portions as shown in FIG. 6, so that the wearer can use the glove 1 with no feeling of wrongness as compared with a conventional glove provided with no reinforcing portion. Further, the quantity of the material for the reinforcer 15 can be reduced.

The glove 1 according to Example 2 is typically employed by a second baseman or a shortstop.

In relation to items of Example 2 similar to those of the aforementioned Example 1, redundant description is not repeated.

EXAMPLE 3

A glove 1 according to Example 3 of the present invention is a modification of the glove 1 according to each of the aforementioned Examples 1 and 2, and basically has a structure similar to that of the glove 1 according to each of Examples 1 and 2.

Figure 7:
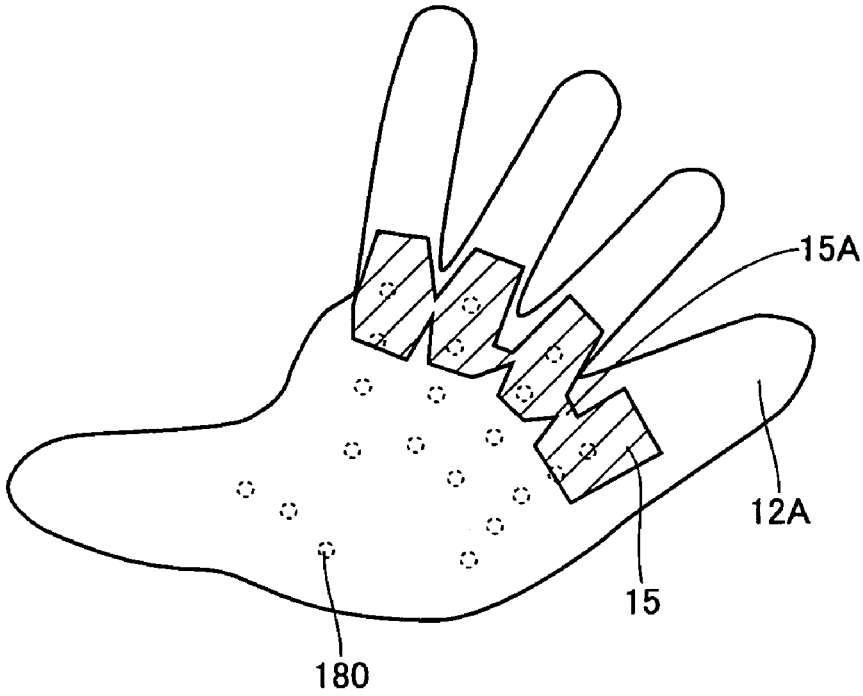

Referring to FIG. 7, a reinforcer 15 is provided in an integrally coupled manner on the surface, coming into contact with the palm of a wearer of the glove 1, of a palm member 12A in the vicinity of the tips of the index to little fingers of the wearer in the glove 1 according to Example 3. The reinforcer 15 has a substantially square shape on each finger (index, middle, ring or little finger) of the wearer. A coupling portion 15A having a relatively small width connects the squares located on each pair of adjacent fingers.

The reinforcer 15 is so provided in the integrally coupled manner with notches as shown in FIG. 7 that transmission of transverse power can be improved similarly to Example 1 while ensuring flexibility of the glove 1.

The glove 1 according to Example 3 is typically employed by a second baseman or a shortstop.

In relation to items of Example 3 similar to those of the aforementioned Examples 1 and 2, redundant description is not repeated.

EXAMPLE 4

A glove 1 according to Example 4 of the present invention is a modification of the glove 1 according to each of the aforementioned Examples 1 to 3, and basically has a structure similar to that of the glove 1 according to each of the aforementioned Examples 1 to 3.

Figure 8:
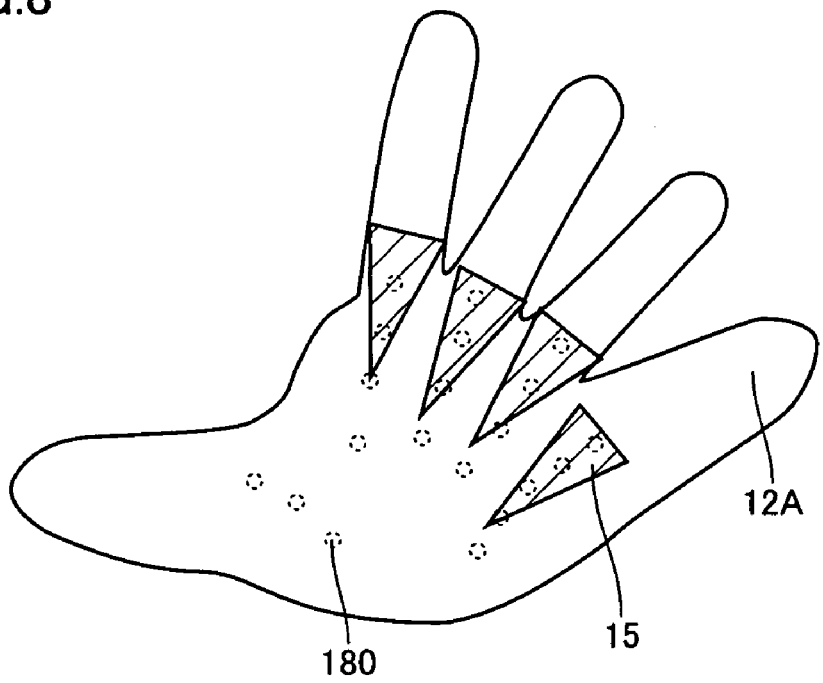

Referring to FIG. 8, a reinforcer 15 is divided into four portions having tapered shapes reduced in width from sides closer to the fingertips of a wearer of the glove 1 toward sides closer to the bases of the wearer's fingers respectively on the surface, coming into contact with the wearer's palm, of a palm member 12A in the vicinity of the tips of the index to little fingers of the wearer.

The reinforcer 15 is so taperingly formed as shown in FIG. 8 that rigidity distribution can be implemented in response to finger power reduced from the fingertips toward the bases of the fingers.

The glove 1 according to Example 4 is typically employed by a second baseman or a shortstop.

In relation to items of Example 4 similar to those of the aforementioned Examples 1 to 3, redundant description is not repeated.

EXAMPLE 5

A glove 1 according to Example 5 of the present invention is a modification of the glove 1 according to each of the aforementioned Examples 1 to 4, and basically has a structure similar to that of the glove 1 according to each of the aforementioned Example 1 to 4.

Figure 9:
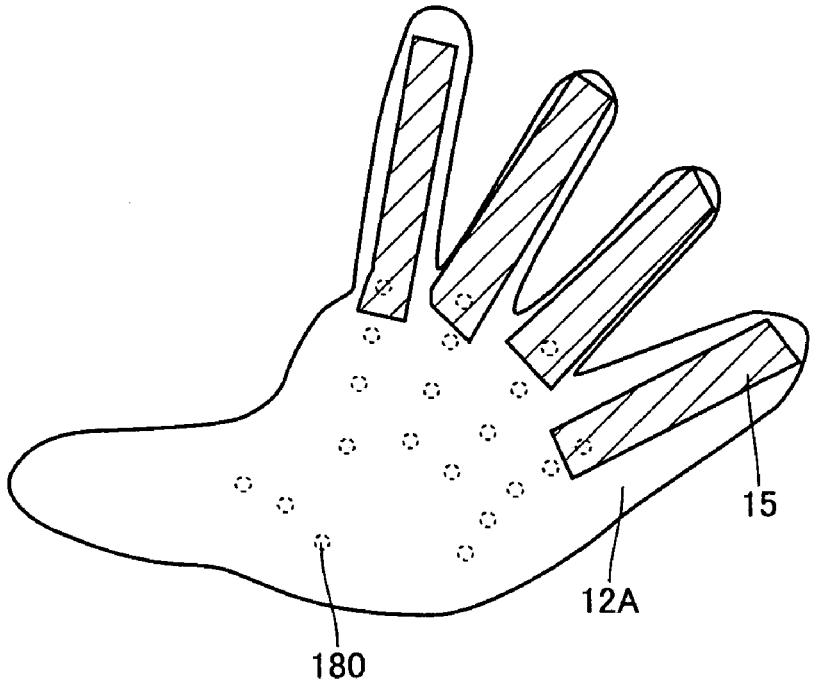

Referring to FIG. 9, a reinforcer 15 is divided into four portions provided to reach the forward ends of finger portions receiving the index to little fingers of a wearer of the glove 1 from portions close to the tips of the index to little fingers respectively on the surface, coming into contact with the wearer's palm, of a palm member 12A in the glove 1 according to Example 5.

The reinforcer 15 is so extended toward the forward ends of the glove 1 as shown in FIG. 9 that the effect of reinforcement can be exerted up to the forward ends of the glove 1.

The glove 1 according to Example 5 is typically employed by a second baseman or a shortstop.

In relation to items of Example 5 similar to those of the aforementioned Examples 1 to 4, redundant description is not repeated.

EXAMPLE 6

A glove 1 according to Example 6 of the present invention is a modification of the glove 1 according to each of the aforementioned Example 1 to 5, and basically has a structure similar to that of the glove 1 according to each of the aforementioned Examples 1 to 5.

Figure 10:
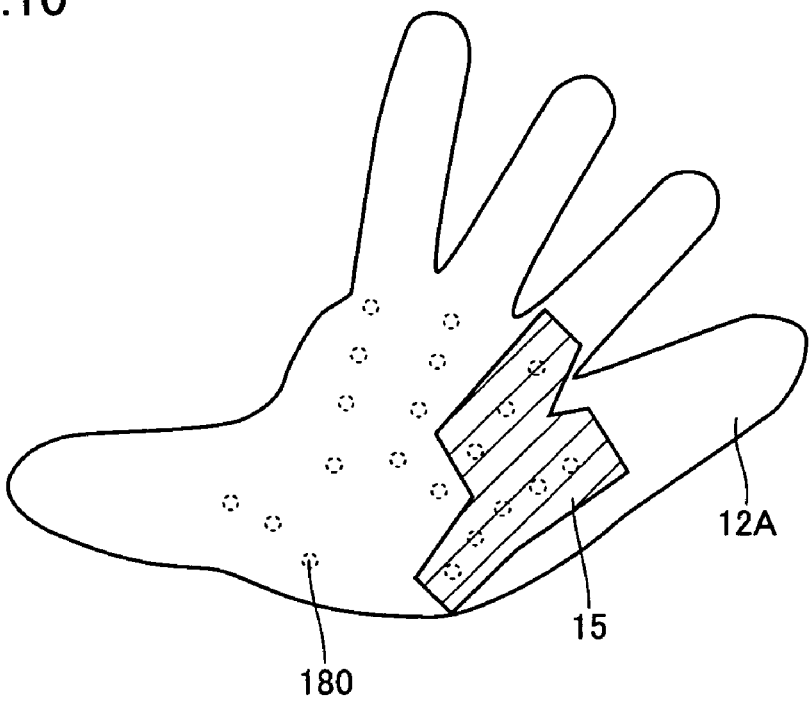

Referring to FIG. 10, a reinforcer 15 is provided on a part corresponding to regions between the bases and the forward ends of the ring and little fingers of a wearer of the glove 1 on the surface, coming into contact with the wearer's palm, of a palm member 12A in the glove 1 according to Example 6.

The reinforcer 15 is so singly formed as shown in FIG. 10 that power applied by the ring and little fingers can be readily transmitted to the periphery while reducing labor hours for manufacturing the glove 1.

The glove 1 according to Example 6 is typically employed by an outfielder.

In relation to items of Example 6 similar to those of the aforementioned Examples 1 to 5, redundant description is not repeated.

EXAMPLE 7

A glove 1 according to Example 7 of the present invention is a modification of the glove 1 according to each of the aforementioned Examples 1 to 6, and basically has a structure similar to that of the glove 1 according to each of the aforementioned Examples 1 to 6.

Figure 11:
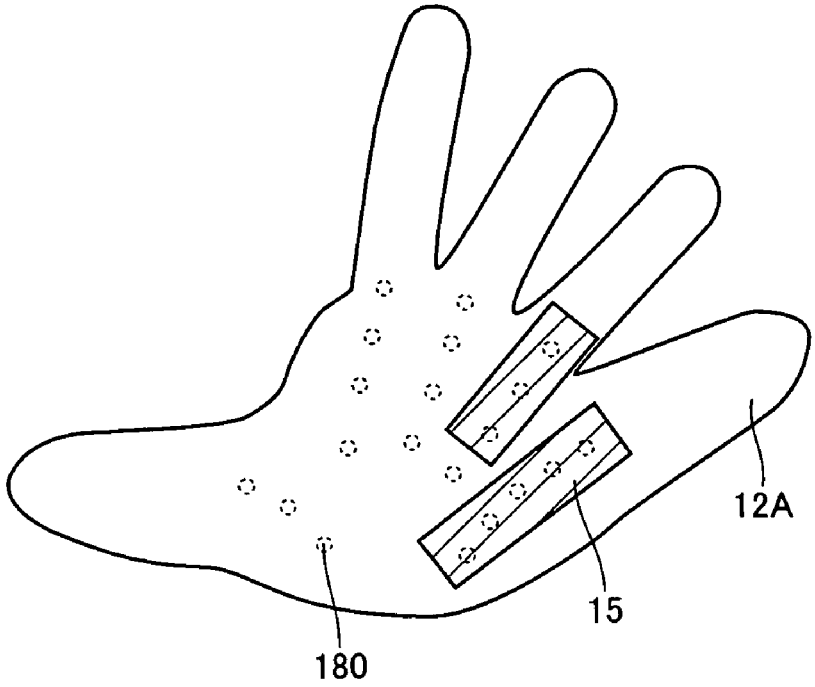

Referring to FIG. 11, a reinforcer 15 is divided into two portions provided on regions corresponding to portions between the bases and the forward ends of the ring and little fingers of a wearer of the glove 1 respectively on the surface, coming into contact with the wearer's palm, of a palm member 12A in the glove 1 according to Example 7.

The reinforcer 15 is so divided into two portions as shown in FIG. 11 that flexibility of the glove 1 can be ensured while rendering power applied by the ring and little fingers of the wearer readily transmittable to the periphery.

The glove 1 according to Example 7 is typically employed by an outfielder.

In relation to items of Example 7 similar to those of the aforementioned Examples 1 to 6, redundant description is not repeated.

EXAMPLE 8

A glove 1 according to Example 8 of the present invention is a modification of the glove 1 according to each of the aforementioned Examples 1 to 7, and basically has a structure similar to that of the glove 1 according to each of the aforementioned Examples 1 to 7.

Figure 12:
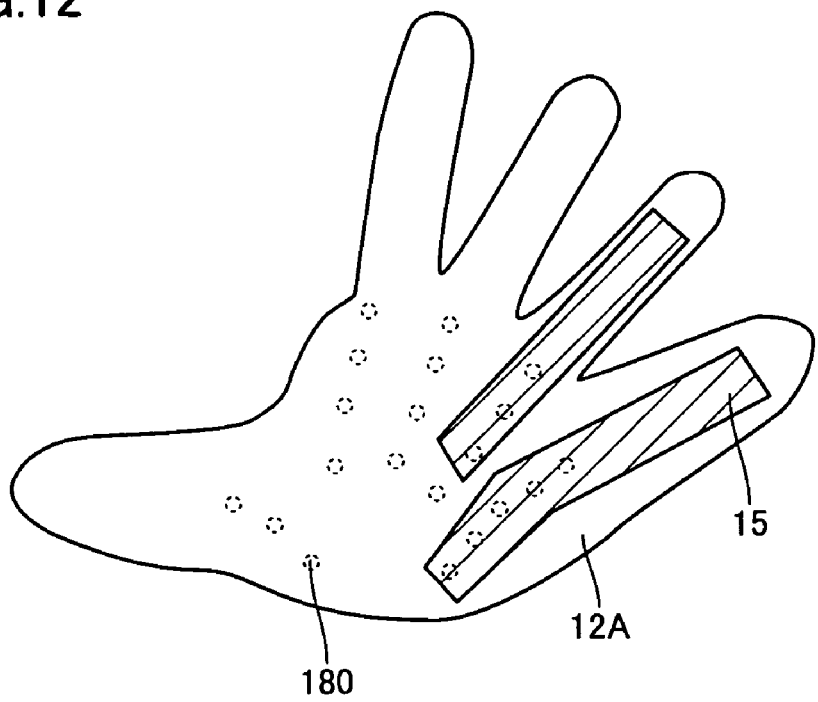

Referring to FIG. 12, a reinforcer 15 is divided into two portions on the surface, coming into contact with the palm of a wearer of the glove 1, of a palm member 12A to extend from portions corresponding to the bases of the ring and little fingers of the wearer toward the forward ends of finger portions receiving the ring and little fingers respectively in the glove 1 according to Example 8.

The reinforcer 15 is so extended toward the forward end of the glove 1 as shown in FIG. 12 that the effect of reinforcement can be exerted up to the forward end of the glove 1.

The glove 1 according to Example 8 is typically employed by an outfielder.

In relation to items of Example 8 similar to those of the aforementioned Examples 1 to 7, redundant description is not repeated.

EXAMPLE 9

A glove 1 according to Example 9 of the present invention is a modification of the glove 1 according to each of the aforementioned Examples 1 to 8, and basically has a structure similar to that of the glove 1 according to each of the aforementioned Examples 1 to 8.

Figure 13:
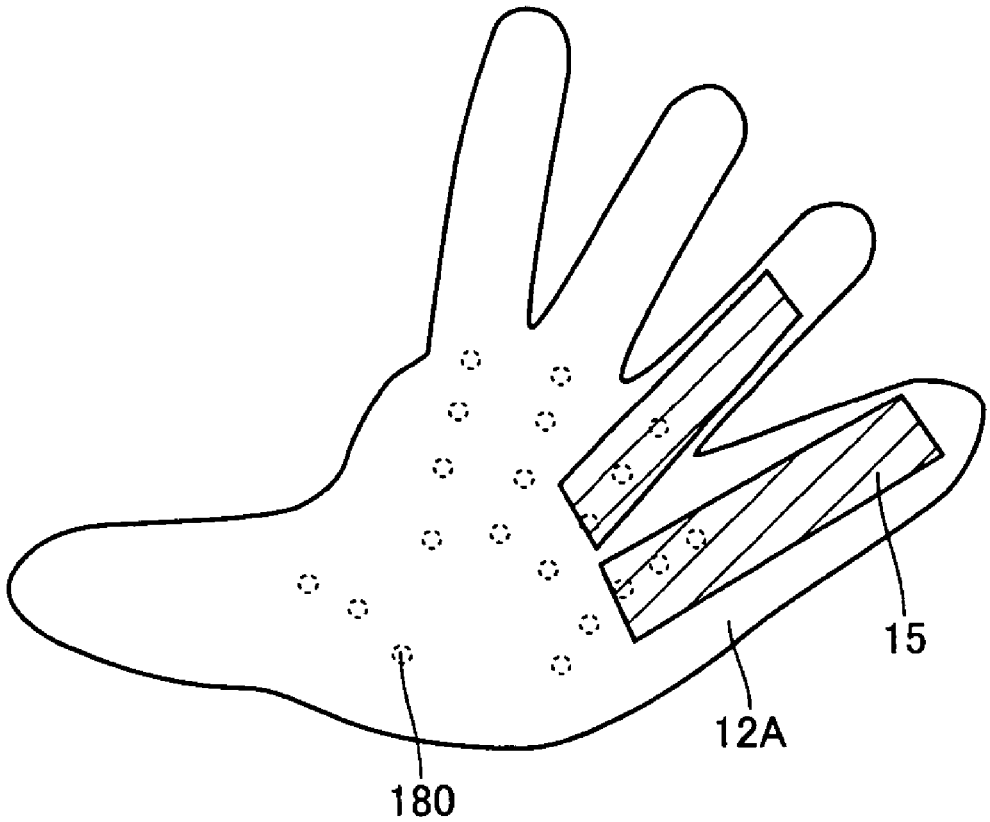

As shown in FIG. 13, a reinforcer 15 is divided into two portions on the surface, coming into contact with the palm of a wearer of the glove 1, of a palm member 12A to extend from portions corresponding to the longitudinal centers of the ring and little fingers of the wearer to the forward ends of finger portions receiving the ring and little fingers respectively in the glove 1 according to Example 9.

The reinforcer 15 is provided not from the bases but from the central portions of the fingers as shown in FIG. 13 so that a highly flexible pocket portion can be relatively widely ensured and the wearer can readily catch a ball with the glove 1.

The glove 1 according to Example 9 is typically employed by an outfielder.

In relation to items of Example 9 similar to those of the aforementioned Examples 1 to 8, redundant description is not repeated.

EXAMPLE 10

Figure 14:
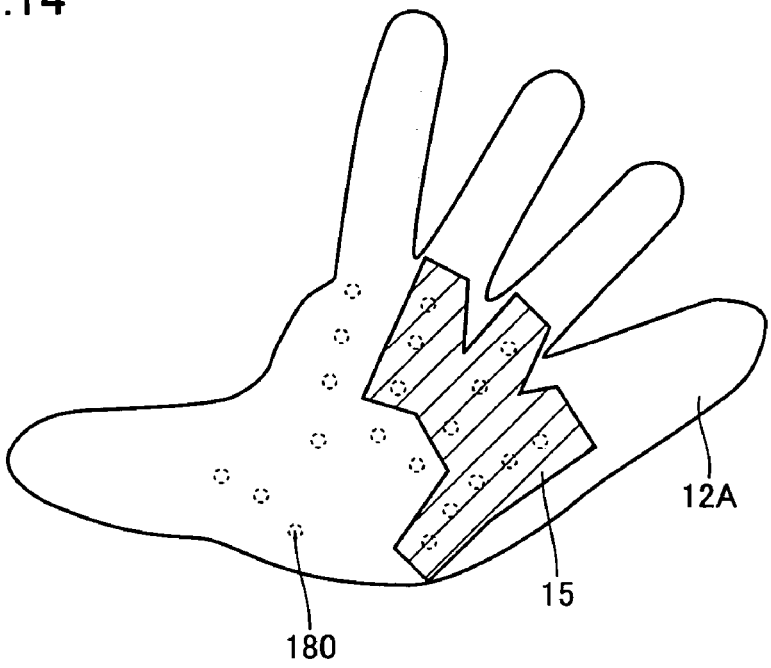

A glove 1 according to Example 10 of the present invention is a modification of the glove 1 according to the aforementioned Example 6 (FIG. 10), and different from Example 6 in a point that a reinforcer 15 is provided also on a position corresponding to the middle finger of a wearer of the glove 1 as shown in FIG. 14.

The glove 1 according to Example 10 is typically employed by a third baseman.

In relation to items of Example 10 similar to those of the aforementioned Example 6, redundant description is not repeated.

EXAMPLE 11

Figure 15:
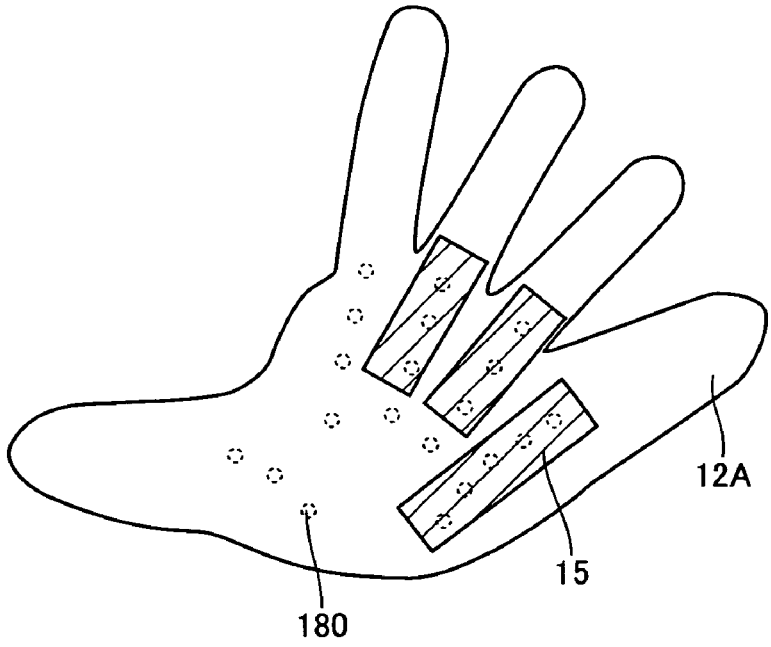

A glove 1 according to Example 11 of the present invention is a modification of the glove 1 according to the aforementioned Example 7 (FIG. 11), and different from Example 7 in a point that a reinforcer 15 is provided also on a position corresponding to the middle finger of a wearer of the glove 1 as shown in FIG. 15.

The glove 1 according to Example 11 is typically employed by a third baseman.

In relation to items of Example 11 similar to those of the aforementioned Example 7, redundant description is not repeated.

EXAMPLE 12

Figure 16:
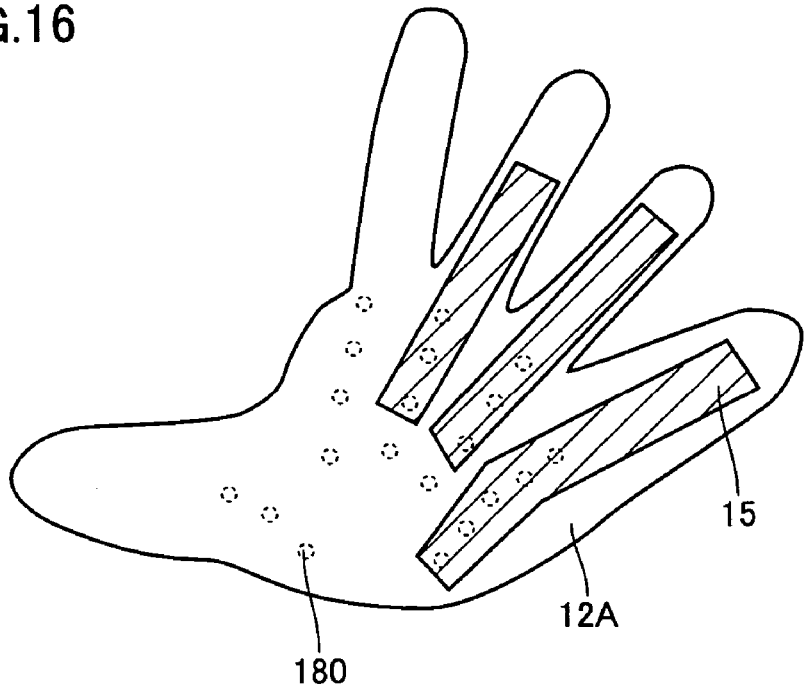

A glove 1 according to Example 12 of the present invention is a modification of the glove 1 according to the aforementioned Example 8 (FIG. 12), and different from Example 8 in a point that a reinforcer 15 is provided also on a position corresponding to the middle finger of a wearer of the glove 1 as shown in FIG. 16.

The glove 1 according to Example 12 is typically employed by a third baseman.

In relation to items of Example 12 similar to those of the aforementioned Example 8, redundant description is not repeated.

EXAMPLE 13

Figure 17:
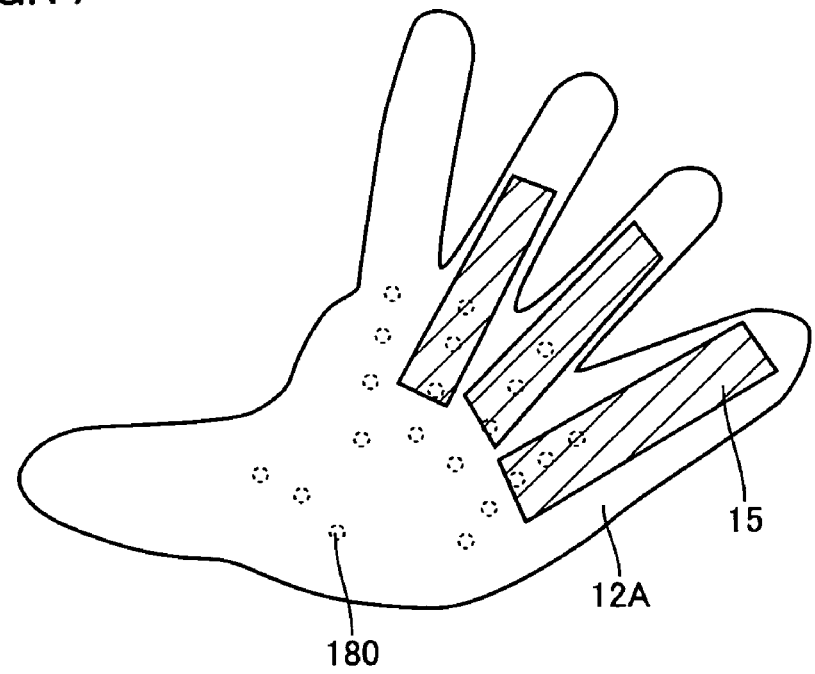

A glove 1 according to Example 13 of the present invention is a modification of the glove 1 according to the aforementioned Example 9 (FIG. 13), and different from Example 9 in a point that a reinforcer 15 is provided also on a position corresponding to the middle finger of a wearer of the glove 1 as shown in FIG. 17.

The glove 1 according to Example 13 is typically employed by a third baseman.

In relation to items of Example 13 similar to those of the aforementioned Example 9, redundant description is not repeated.

The effect (improvement of ball grasping power) of the aforementioned reinforcer 15 provided on each glove 1 is now described. The gloves 1 according to Examples 3 and 9 are employed for verifying the effect.

A state of measuring power for grasping a ball 14 with a glove 1 through a load meter 16 is described with reference to FIG. 18.

Figure 18:
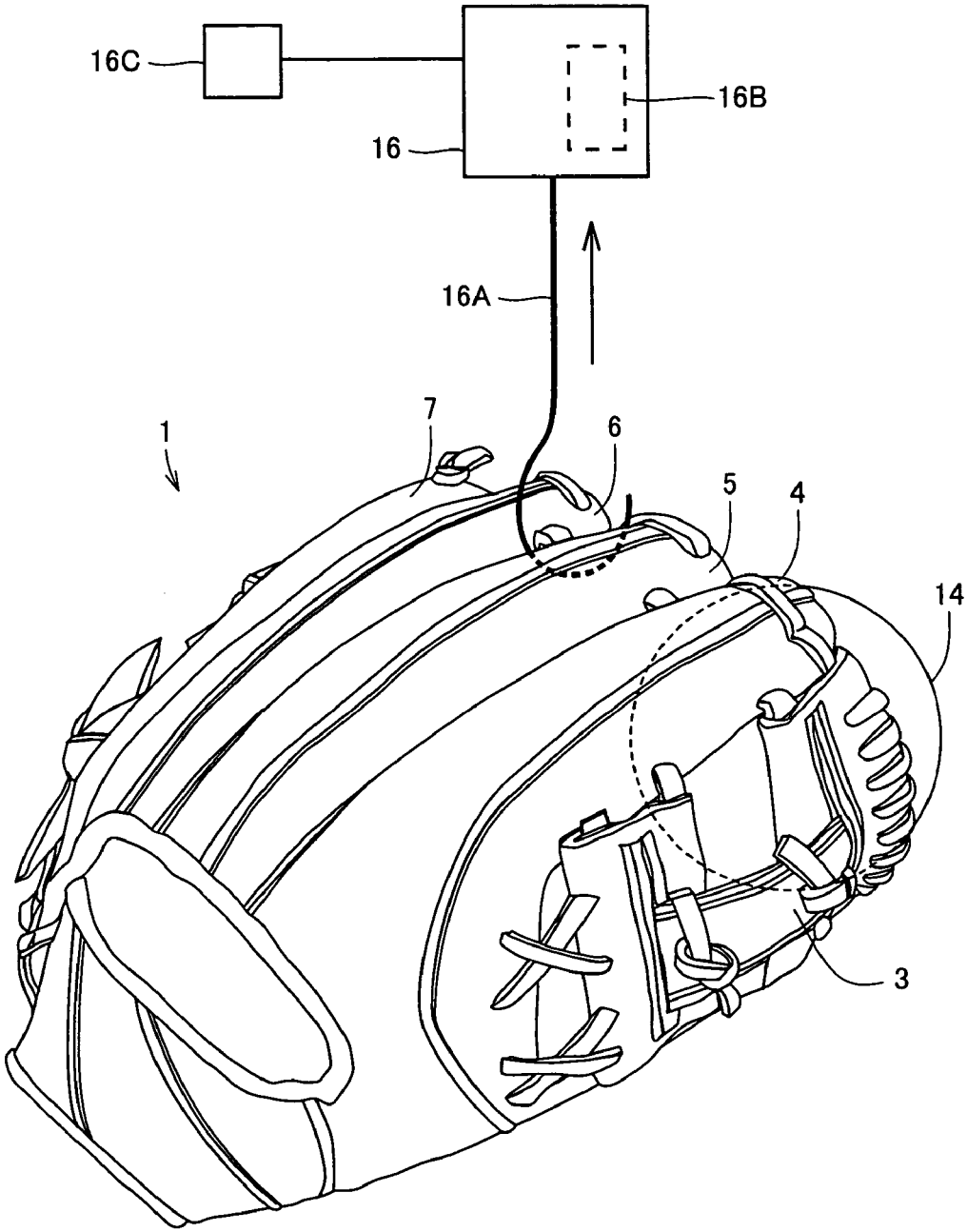
FIG. 18 illustrates a state of measuring power for grasping a ball with a catching tool through a load meter.
Figure 19:
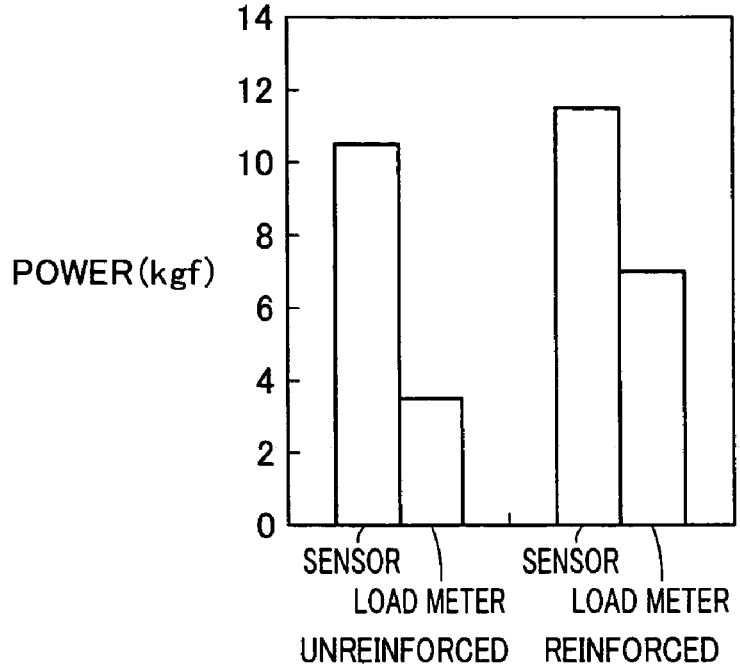
FIGS. 19 to 23 illustrate comparative results (cases 1 to 5) related to power transmission rates in catching tools respectively.
Figure 20:
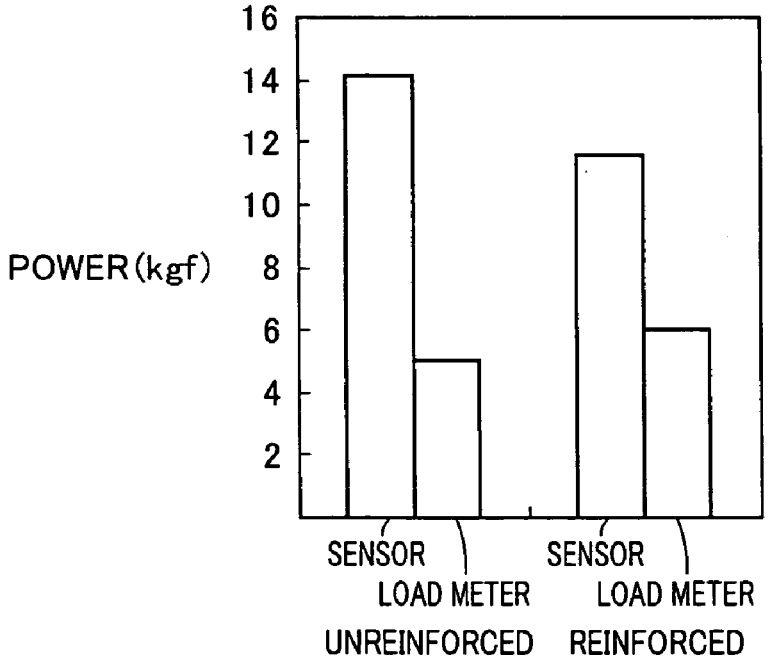
Figure 21:
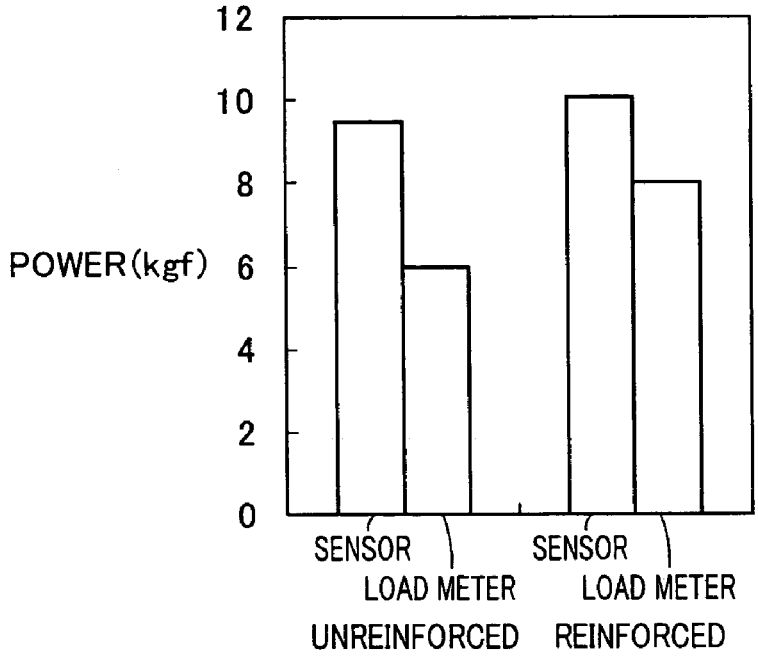
Figure 22:
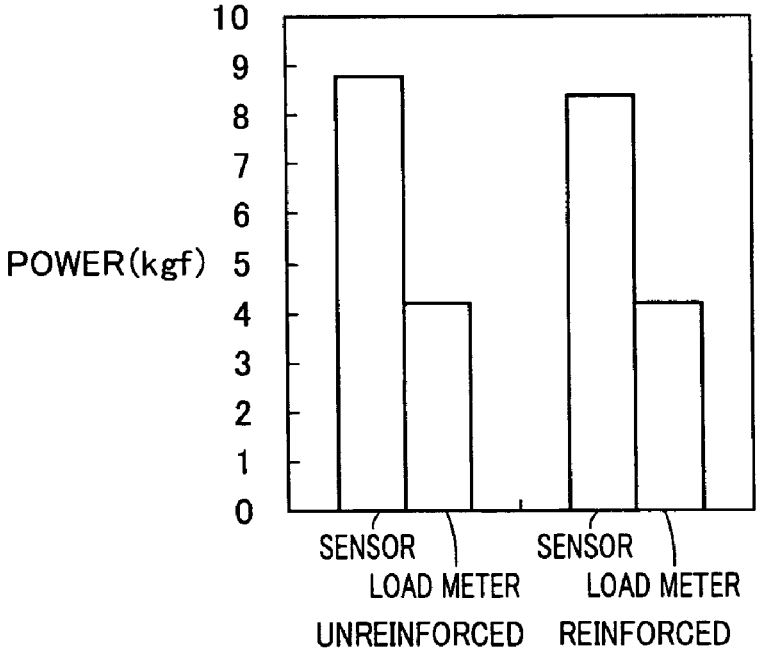
Figure 23:
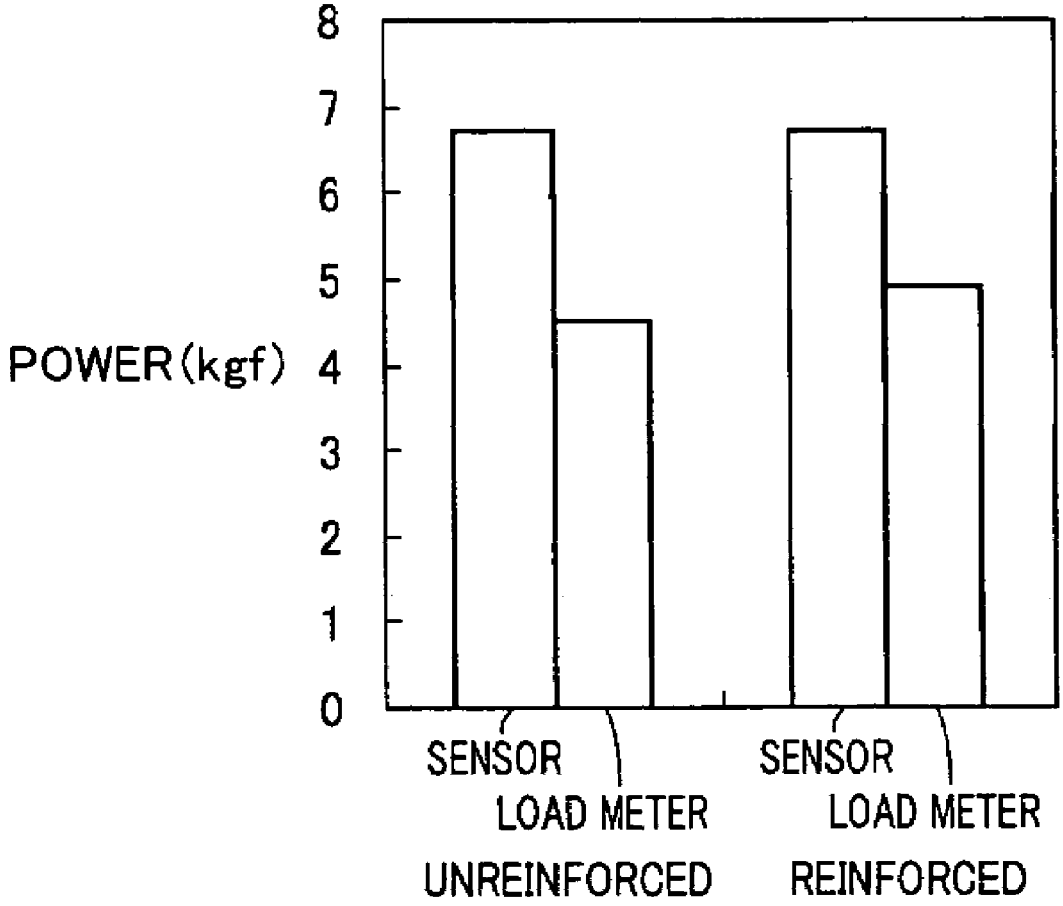

Referring to FIG. 18, the ball 14 is grasped with the glove 1 in a state projecting by about ⅓ from a web portion 3. The hand (not shown) of a wearer (subject) of the glove 1 applies power for gripping the glove 1 so that the ball 14 does not fall from the glove 1. A hook portion 16A is mounted on the load meter 16. The load meter 16 pulls the hook portion 16A hung between a middle finger stall 5 and a ring finger stall 6 along arrow (upward) in FIG. 18. Thus, the load meter 16 applies power for opening the glove 1 and dropping the ball 14 from the glove 1. A controller 16B controls the magnitude of the power applied by the load meter 16. A monitor 16C displays this magnitude of the power. For example, Autograph/AG-5000D by Shimadzu Corporation is employed as the load meter 16.

On the other hand, the aforementioned sensor unit 17 is attached to the hand of the wearer of the glove 1. If the power applied from the load meter 16 for opening the glove 1 exceeds power for closing the forward end of the glove 1, the ball 14 drops from the glove 1. The sensor unit 17 measures the power of the wearer grasping the glove 1 when the ball 14 drops. The monitor 16C displays the magnitude of the power for opening the glove 1 when the ball 14 drops.

In order to simply perform the aforementioned measurement, a spring balance is employed as the load meter 16.

Results of comparison (cases 1 to, 5) related to transmission rates of power for grasping the ball 14 with the glove 1 are described with reference to FIGS. 19 to 23.

In the cases 1 to 3 (FIGS. 19 to 21), the glove 1 (reinforced) according to Example 3 and a glove (unreinforced) prepared by removing the reinforcer 15 from the glove 1 are compared with each other. In the cases 4 and 5 (FIGS. 22 and 23), the glove 1 (reinforced) according to Example 9 and a glove (unreinforced) prepared by removing the reinforcer 15 from the glove 1 are compared with each other.

FIGS. 19 to 23 display the values of power measured through the sensor unit 17 ("sensor") and the load meter 16 when balls 14 dropped from the gloves 1 (reinforced) and the gloves (unreinforced) respectively.

Referring to FIGS. 19 to 23, the power measured through the "sensor" is larger than the power measured through the "load meter" in each case. The power measured through the "sensor" corresponds to the magnitude of the power of the wearer of the glove grasping the glove, while the power measured through the "load meter" corresponds to the magnitude of the power for opening the forward end of the glove through the load meter 16. Therefore, it follows that the power of the wearer grasping the glove is efficiently transmitted as the power for closing the forward end of the glove as the ratio of the power measured through the "load meter" to the power measured through the "sensor" is increased. This ratio is referred to as the "transmission rate of power".

Figure 24:
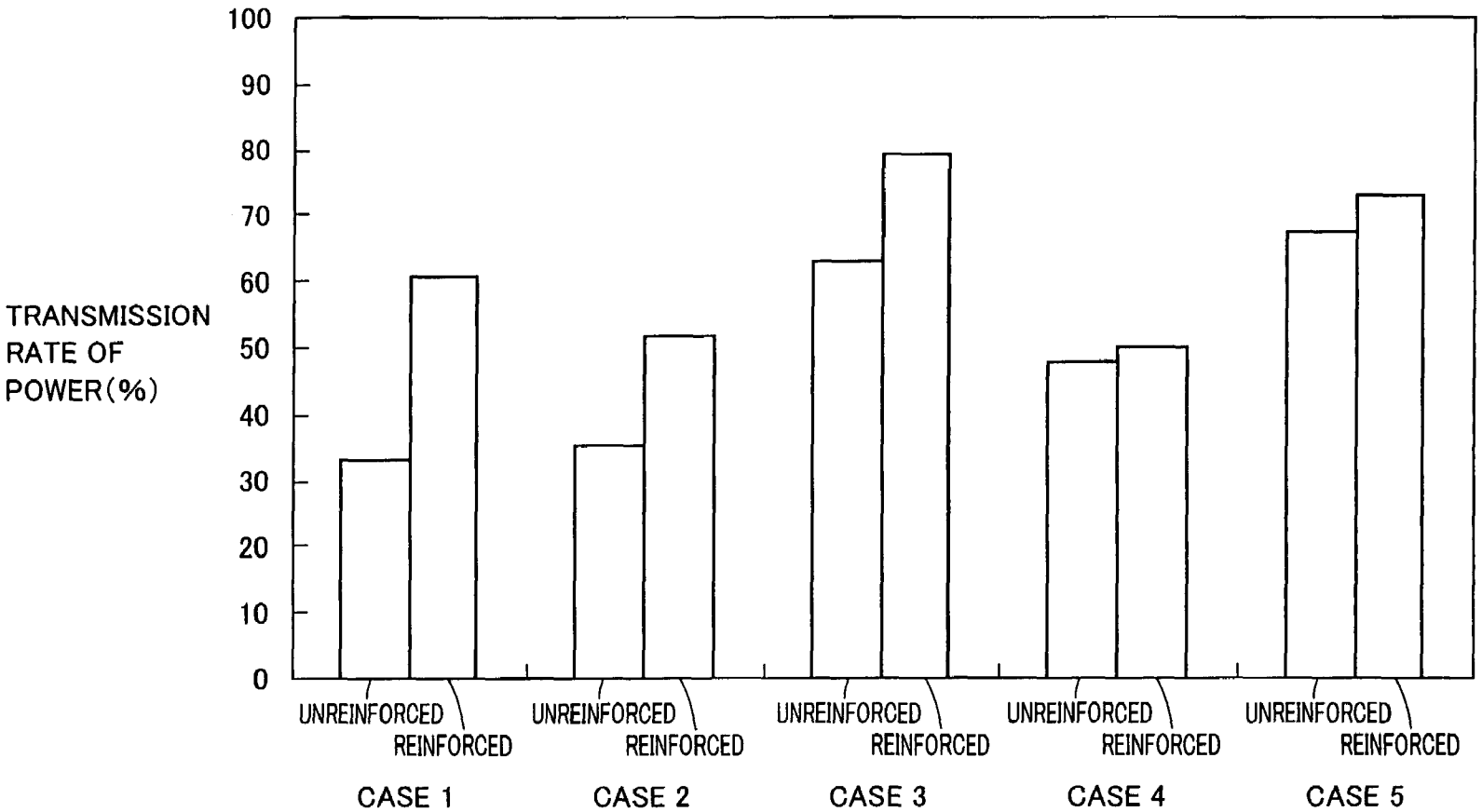
FIG. 24 illustrates the power transmission rates related to the cases 1 to 5 shown in FIGS. 19 to 23.

Referring to FIG. 24, it is understood that the "transmission rate of power" is improved in the "reinforced" glove as compared with the "unreinforced" glove in each of the cases 1 to 5. Thus, it is understood that the finger power of the wearer is efficiently transmitted to the overall glove 1 (the forward end, for example) due to the arrangement of the reinforcer 15.

While the embodiment and Examples of the present invention have been described, proper combination of characteristic portions of the aforementioned embodiment and Examples has been planned from the first.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, the inner leather member having a palm portion provided along said pocket portion and a back portion provided along said back face portion, the palm, back, pocket, and back face portions forming a thumb stall, an index finger stall, a middle finger stall, a ring finger stall, and a little finger stall, each finger stall having a base, a forward end, and a finger tip contact portion disposed between the base and forward end, wherein the finger tip contact portion is an area of the palm portion that is configured to contact the finger tips of a user wearing the catching tool; and reinforcing portions selectively provided on the finger tip contact portions of the index finger, middle finger, ring finger, and little finger stalls, the reinforcing portions composed of a material harder than the palm portion.

2. The catching tool according to claim 1, wherein said reinforcing portions extend from the finger tip contact portions to the bases of index finger, middle finger, ring finger, and little finger stalls.

3. The catching tool according to claim 1, the reinforcing portions being superimposed on the palm portion.

4. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, the inner leather member having a palm portion provided along said pocket portion and a back portion provided along said back face portion, the palm, back, pocket, and back face portions forming a thumb stall, an index finger stall, a middle finger stall, a ring finger stall, and a little finger stall, each finger stall having a base, a forward end, and a finger tip contact portion disposed between the base and forward end, wherein the finger tip contact portion is an area of the palm portion that is configured to contact the finger tips of a user wearing the catching tool; and reinforcing portions composed of a material harder than the palm portion, the reinforcing portions consisting of a first reinforcing portion disposed on the ring finger stall and a second reinforcing portion disposed on the little finger stall.

5. The catching tool according to claim 4, wherein the first and second reinforcing portions extend from the finger tip contact portions to the bases of the ring finger and little finger stalls.

6. The catching tool according to claim 4, wherein the first and second reinforcing portions extend from the finger tip contact portions to the forward ends of the ring finger and little finger stalls.

7. The catching tool according to claim 4, the reinforcing portions being superimposed on the palm portion.

8. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, the inner leather member having a palm portion provided along said pocket portion and a back portion provided along said back face portion, the palm, back, pocket, and back face portions forming a thumb stall, an index finger stall, a middle finger stall, a ring finger stall, and a little finger stall, each finger stall having a base, a forward end, and a finger tip contact portion disposed between the base and forward end, wherein the finger tip contact portion is an area of the palm portion that is configured to contact the finger tips of a user wearing the catching tool; and reinforcing portions composed of a material harder than the palm portion, the reinforcing portions consisting of a first reinforcing portion disposed on the middle finger stall, a second reinforcing portion on the ring finger stall, and a third reinforcing portion disposed on the little finger stall.

9. The catching tool according to claim 8, wherein the first, second, and third reinforcing portions extend from the finger tip contact portions to the bases of the middle finger, ring finger, and little finger stalls.

10. The catching tool according to claim 8, wherein the first, second, and third reinforcing portions extend from the finger tip contact portions to the forward ends of the middle finger, ring finger, and little finger stalls.

11. The catching tool according to claim 8, the reinforcing portions being superimposed on the palm portion.

12. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, the inner leather member having a palm portion provided along said pocket portion, a back portion provided along said back face portion as well as an index finger portion, a middle finger portion, a ring finger portion and a little finger portion receiving the index finger, the middle finger, the ring finger and the little finger of a wearer of said catching tool respectively, each finger portion having a base; and a first reinforcing portion selectively provided on an area of the palm portion forming the bases of said index finger portion, said middle finger portion, said ring finger portion and said little finger portion, the first reinforcing portion composed of a material harder than the palm portion, wherein the first reinforcing portion is the only reinforcing portion provided on the palm portion.

13. The catching tool according to claim 12, the first reinforcing portion being superimposed on the palm portion.

14. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, having a palm portion provided along said pocket portion, a back portion provided along said back face portion as well as a ring finger portion and a little finger portion receiving the ring finger and the little finger of a wearer of said catching tool respectively; and a first reinforcing portion selectively provided on an area of the palm portion forming the bases of said ring finger portion and said little finger portion, the first reinforcing portion composed of a material harder than the palm portion, wherein the first reinforcing portion is the only reinforcing portion provided on the palm portion.

15. The catching tool according to claim 14, the first reinforcing portion being superimposed on the palm portion.

16. A catching tool comprising:

an outer leather member including a pocket portion and a back face portion forming an index finger portion, a middle finger portion, a ring finger portion, a little finger portion, a thumb portion, and a webbing disposed between the thumb and index finger portions;

an inner leather member, inserted in and affixed by a fastening element to said outer leather member, having a palm portion provided along said pocket portion, a back portion provided along said back face portion as well as a middle finger portion, a ring finger portion, and a little finger portion receiving the middle finger, the ring finger and the little finger of a wearer of said catching tool respectively; and a first reinforcing portion selectively provided on an area of the palm portion forming the bases of said middle finger portion, said ring finger portion and said little finger portion, the first reinforcing portion composed of a material that is harder than the palm portion, wherein the first reinforcing portion is the only reinforcing portion provided on the palm portion.

17. The catching tool according to claim 16, the first reinforcing portion being superimposed on the palm portion.

18. A method of making a reinforced catching tool, comprising:

providing an outer leather member including a pocket portion and a back face portion forming an index finger portion, a middle finger portion, a ring finger portion, a little finger portion, a thumb portion, and a webbing disposed between the thumb and index finger portions;

providing an inner leather member, inserted in and affixed by a fastening element to said outer leather member, the inner leather member having a palm portion provided along said pocket portion and a back portion provided along said back face portion, the palm, back, pocket, and back face portions forming a thumb stall, an index finger stall, a middle finger stall, a ring finger stall, and a little finger stall, each finger stall having a base, a forward end, and a finger tip contact portion disposed between the base and forward end, wherein the finger tip contact portion is an area of the palm portion that is configured to contact the finger tips of a user wearing the catching tool;

measuring distribution of pressure applied by the fingers of a wearer of said catching tool to said catching tool when catching a ball with a pressure sensor;

providing a reinforcing portion on a portion of the catching tool receiving relatively large pressure inside a pocket portion in said catching tool on the basis of a result of the measurement; and affixing the reinforcing portions to the catching tool.

* * * * *